US005368112A

United States Patent [19]

Mount et al.

[11] Patent Number: 5,368,112

[45] Date of Patent: Nov. 29, 1994

[54] TENSIONING APPARATUS FOR TIE DOWN LINES

[75] Inventors: Matthew J. Mount, Long Beach; David G. Hopkins, Riverside, both of Calif.

[73] Assignee: Union Oil Company of California, Los Angeles, Calif.

[21] Appl. No.: 100,623

[22] Filed: Jul. 30, 1993

[51] Int. Cl.[5] ..... E21B 15/00

[52] U.S. Cl. ..... 175/122; 175/162

[58] Field of Search ..... 175/122, 85, 162, 220, 175/170, 171

[56] References Cited

U.S. PATENT DOCUMENTS

| | | | |
|---|---|---|---|
| 3,011,570 | 12/1961 | Kurt et al. | 175/122 |
| 4,523,645 | 6/1985 | Moore | 175/162 X |
| 5,107,940 | 4/1992 | Berry | 175/162 X |
| 5,211,248 | 5/1993 | Nosewicz et al. | 175/122 X |

OTHER PUBLICATIONS

Applied Drilling Engineering, Society of Petroleum Engineers, Adam T. Bourgoyne, Jr., Keith K. Millheim, Martin E. Chenevert and F. S. Young, Jr., Richardson, Tex. 1986, pp. 17–21.

*Primary Examiner*—Michael Powell Buiz
*Attorney, Agent, or Firm*—Gregory F. Wirzbicki; William O. Joacobson

[57] ABSTRACT

A measured and controlled tension is applied to one or more lines or cables attached to a drilling rig. Preferably, the tensioned line provide reactive torque support for the power swivel, The controlled tension allows a greater power swivel torque to be used on existing drilling rig structures and better distributes any portion of the torque load reacted by the structure. The controlled tension system can also be integrated into a fail-safe control system, where sensed cable failure or excessive cable loads cause a safe shutdown of operations, or the measured tension may also be based to control other drilling operations, such as hoisting speeds.

16 Claims, 3 Drawing Sheets

TENSIONING APPARATUS FOR TIE DOWN LINES

FIELD OF THE INVENTION

This invention relates to drilling devices and processes. More specifically, the invention is concerned with providing tie-down support for a power swivel.

Background of the Invention

Rotary drilling is a common method used to drill, bore, and excavate oil and gas wells. Normally, relatively large drilling rigs are used for these wells. The large drilling rigs typically have kelly tables (aid associated support equipment) for rotating a square kelly (attached to the pipe string) in a kelly bushing. These large drilling rigs (and kelly tables) cover a large area (i.e., have a large footprint) and are typically capable of generating rotary torques of 35,000 foot-pounds (47,460 joules) or more.

The derrick structures of these large drilling rigs may be assembled on site and must be capable of withstanding these rotary torques and other loads. The derrick structure combined with the large footprint of these assembled drilling rigs typically does not require guy wire torsional or other support, e.g., against wind loads, of these derrick structures.

For normal workover (or other drilling) operations not requiring large torques, a smaller truck transportable workover or production rig can be used. The smaller rig typically has a preassembled mast that is field erected instead of a field assembled derrick. Rotation is typically accomplished using a power swivel or power sub rotating the pipe string, replacing the kelly and associated equipment.

The truck transportable rig is positioned and the smaller footprint mast structure is raised and positioned over the well. Guy wires attached between the crown or top of the derrick and ground anchors spaced apart from the wellhead are typically installed because the lighter and smaller footprint mast may not withstand wind loads without the guy wires. Some of the guy wires are also, positioned to support the mast in a slightly tilted-from-the-vertical orientation, allowing clearance between the mast and the power swivel hung on the crown of the mast. Cables or guy wires can also take out a portion of the torque loads generated by the power swivel, allowing further lightening of the transportable mast structure.

The power swivel is typically supported on a hook or travelling block of the lighter weight drilling rig and rotary torque is reacted through an arm of the power swivel looped around a wire line or torque cable which is secured to the rig. The torque cable and loop attachment allows the power swivel to apply torque while vertically traveling with the pipe string as the pipe string is run into the well. The torque cable and loop attachment of the arm of the power swivel also minimizes, but does not avoid non-vertical forces on the drilling rig structure.

Torques generated by a power swivel are typically limited for a given size production drilling rig. For example, a torque limit of 2500 ft-lbs (3390 joules) is typical for an Ideco production drilling rig having a, nominal 96 foot (29.26 meter) high mast and nominal 200,000 pound (90,720 kilogram) lifting capacity.

Even with these torque limitations, the torque cable reaction support or tie down system may allow unwanted motion of the offset arm and cable as torque is applied to the pipe string. Motion of the cable and the offset arm may present safety risks (e.g., if the power swivel arm is close to a personnel working floor), hardware damage risks (e.g., if the arms of the power swivel impact the mast), or other problems.

Current cable and/or guy wire support approaches present the problem of unwanted power swivel motion unless significant stress is added to the lightweight drilling rig structure. In addition, the torque limitations can preclude workover or other operations that might otherwise be accomplished with a lightweight or production drilling rig, especially when work, over of a deviated or extended reach well is required.

SUMMARY OF THE INVENTION

Such problems are avoided by impressing a measured and controlled tension to one or more tie down lines attached to a drilling rig mast or derrick. Preferably, the tensioned cables provide direct reactive torque support for the arms of a power swivel looped around the cable. The use of a looped cable attachment, a line tension measurement or indication, and a controllable tension actuator achieves several benefits, including balancing torsion loads (when compared to a single and fixed tension cable supports), allowing greater power swivel torque capacity, and limiting total loads on the drilling rig to within safe limits. The present invention can also be integrated Into a fail-safe control system, where sensed cable failure or excessive cable loads cause a safe shutdown of operations.

The tensioning actuator can be controllable based at least in part on the measured or indicated value of tension to create an automatic tensioning system. In addition, the automatic tensioning prevents damage to the derrick or mast caused by excessive peak torque values.

BRIEF DESCRIPTION OF THE DRAWINGS

In these Figures, it is to be understood that like reference numerals refer to like elements or features.

DETAILED DESCRIPTION OF THE INVENTION

Figure 1A:
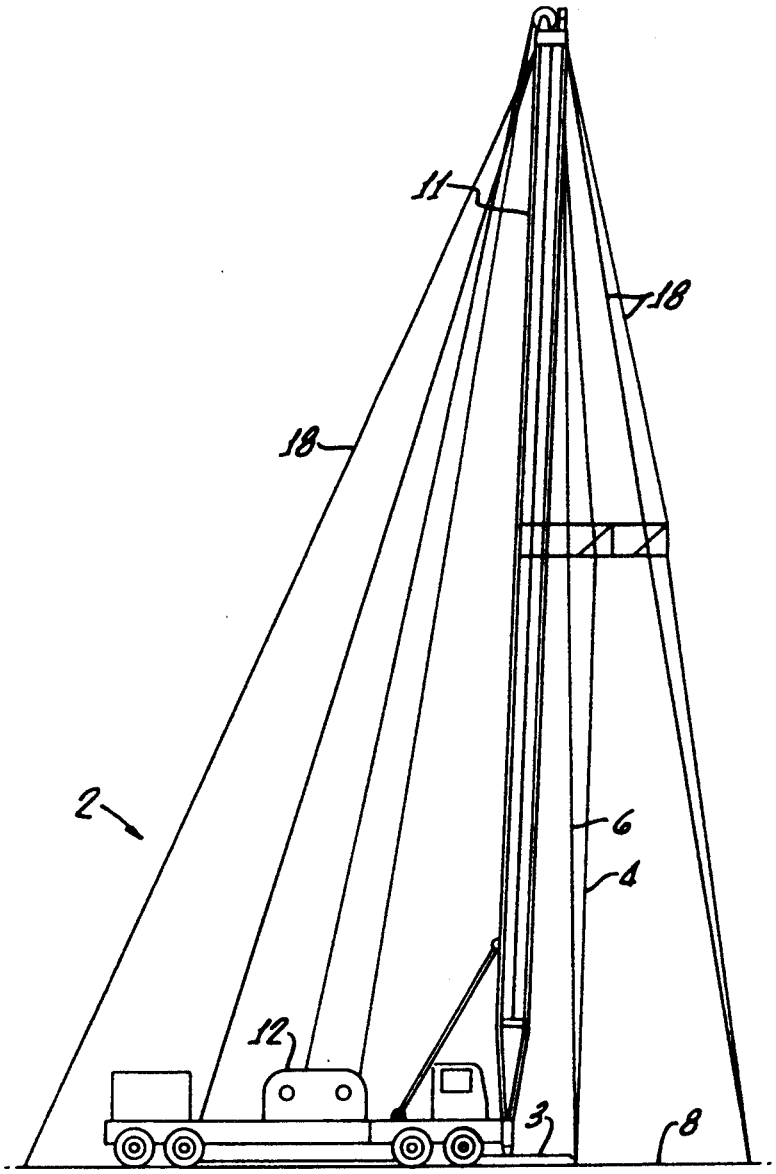
FIGS. 1*a* and 1*b* show front and side views respectively of a truck transportable drilling rig assembly with a looped line power swivel tie-down and line tensioning system.
Figure 1B:
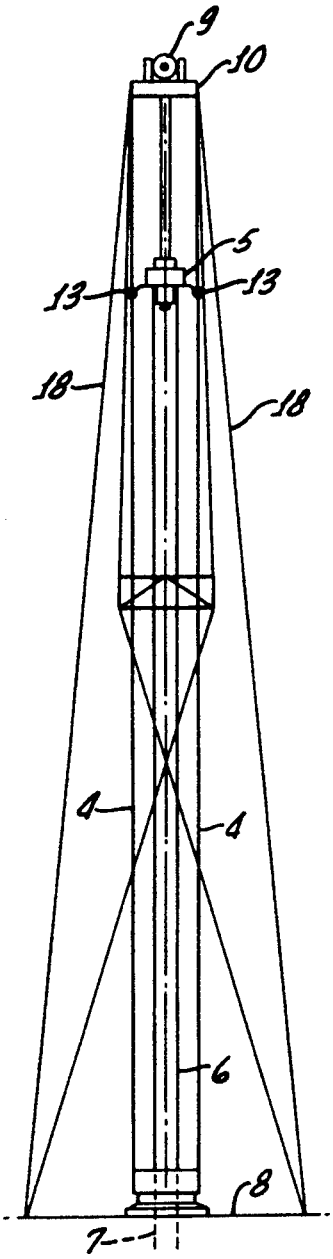

FIG. 1*a* and 1*b* show front and side views, respectively, of a truck transportable rig 2, e.g., a workover or production rig for drilling or maintenance of a well, with a tensioning system 3 of a tie-down or torque cable 4 (typically attached at one end to the crown 10 of the rig and running through the tensioning system and back up to the other end also attached to the crown) which provides reactive support for a power swivel 5. The power swivel 5 rotates a pipe string or tool or tubulars 6 which extend into well 7 below ground surface 8.

The power swivel 5 and pipe string 6 are vertically supported by the hoisting system 9 placed on the crown 10 of derrick or mast 11. A preferred embodiment uses a model FTI-9 through model FTI-75 power swivel obtained from Roto-Tek, a division of Fishing Tools Inc., located in Houston, Tex., and having a nominal rating (in tons) ranging from 80 to 35. The hoisting system 9 supporting the power swivel 5 is driven by a truck mounted drawworks 12.

The hoisting system 9 allows the pipe string 6 (and attached power swivel 5) to be lowered and raised from the well 7 and pipe sections to be added or removed. In drilling operations for example, the hoisting system 9 supports the pipe string 6 as it is rotated by the power swivel 5 into the well 7. When the power swivel 5 is near the ground surface 8, drilling is stopped, the power swivel 5 is disconnected from the pipe string 6, a new section of pipe (not shown) is attached at one end to the power swivel 5 and raised so that the other end can be attached to the pipe string 6, forming a longer pipe string. After rotary drilling brings the power swivel 5 back down to near the ground surface 8 again, another connection to another pipe section completes a "connection" to continue the drilling process.

However, the non-vertical torque of the Dower swivel must be reacted against or supported which is accomplished by the torque cable 4 through one or more, preferably two torque arms 13. The torque cable 4 is attached to the crown 10 of the drilling rig 2 and connected to the tensioning system 3 which is typically weighted, anchored, or otherwise secured to the ground 8. Thus, a portion of the power swivel's reactive torque loads are transferred to the crown 10 and the remainder is transferred to the ground 8 through torque cable 4. By avoiding rigid contact between the power swivel 5 and the mast or derrick 11 and providing a double sided contact with the power swivel 5, unbalanced and direct moment loads on the mast or derrick 11 structure are avoided and the risk of sudden loads causing twist off failures in the pipe string are minimized. The minimized reactive torque loads on the mast or derrick 11 are limited to the balanced moments resulting from tension in doubly attached cable 4 acting on the crown 10.

The torque which is reacted against by the tensioning systems is supplied by a swivel power fluid. The swivel power fluid and drilling fluids are typically supplied to the power swivel 5 through hoses (not shown for clarity). The power fluid is supplied from a power fluid source, such as a hydraulic fluid reservoir and pump. The power fluid drives a fluid motor rotating the attached pipe string, tubulars, or tool 6. Drilling fluid, such as a drilling mud, is typically supplied through a gooseneck and rotary seal fitting to the interior of the pipe string to be circulated downhole and returned to the surface 8.

Figure 2:
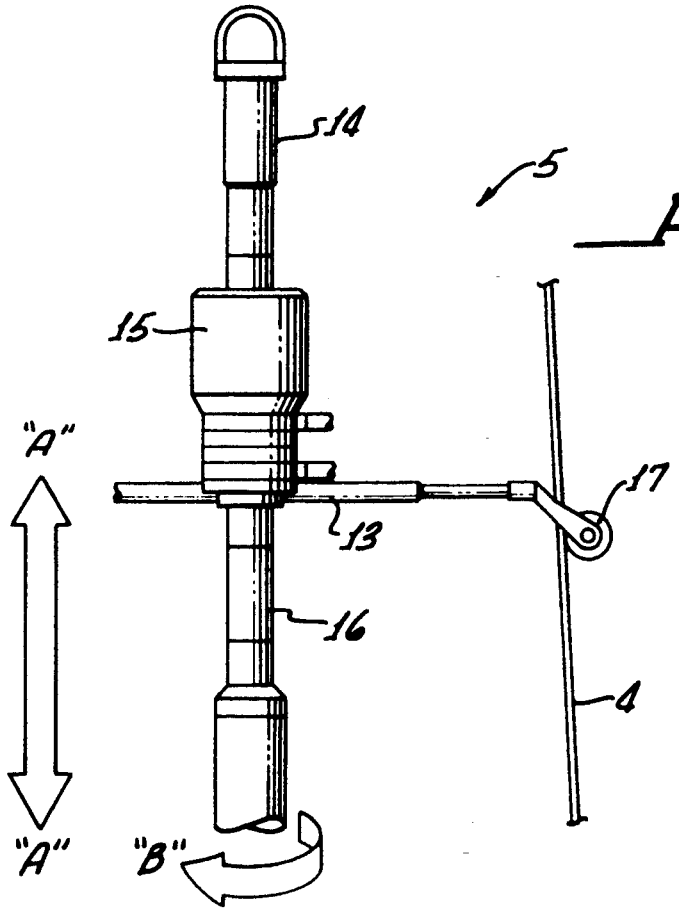
FIG. 2 shows a side view of a power swivel portion of the assembly shown in FIGS. 1*a* and 1*b;*

FIG. 2 shows a power swivel portion of the assembly shown in FIGS. 1*a* and 1*b*. The bail 14 of the power swivel 5 is attached to a hook of a traveling block (not shown for clarity) allowing substantially vertical reciprocating motion "A." The traveling block is supported from the crown 10 of mast 11 (see FIGS. 1*a* and 1*b*).

Power to rotate the pipe section 16 is preferably supplied by a source of hydraulic fluid to the "fluid inlet" and returned (at a lower pressure) at the "fluid outlet" port. The hydraulic fluid drives a fluid motor (mounted within a power swivel housing 15), rotating the attached pipe section 16 in a direction as shown by arrow "B." Alternatively, the power swivel 5 may instead be attached to a cementing casing head or other tool.

The preferred power swivel 5 includes two torque arms 13 (one only shown in part for clarity). Each of the torque arms 13 includes a runner assembly 17 enclosing the torque cable 4. The torque generated by the power swivel 5 tends to counter-rotate the torque arms 13 which are prevented from counter-rotating by deformation and tension in the torque cable 4. As torque is applied, the torque cable 4 is deformed around the runner assembly 17 so that a component of the tensile forces reacts against the counter-rotating force. As torque is increased, counteracting tension can be increased and/or the position of the cable 4 around the runner assembly 17 changed-so that the counteracting component is increased.

Increased torque tends to stretch the cable 4 and, without the tensioning device 3 as shown in FIG. 1, allows position changes and motion of the torque arms 13. With the tensioning device 3 of the invention, cable tension can be held between pre-determined maximum and minimum values and excessive cable stretch removed. Alternatively, cable tension can controllably varied as torque is applied so as to avoid motion of torque arms 13 as torque is applied by the power swivel.

Figure 3:
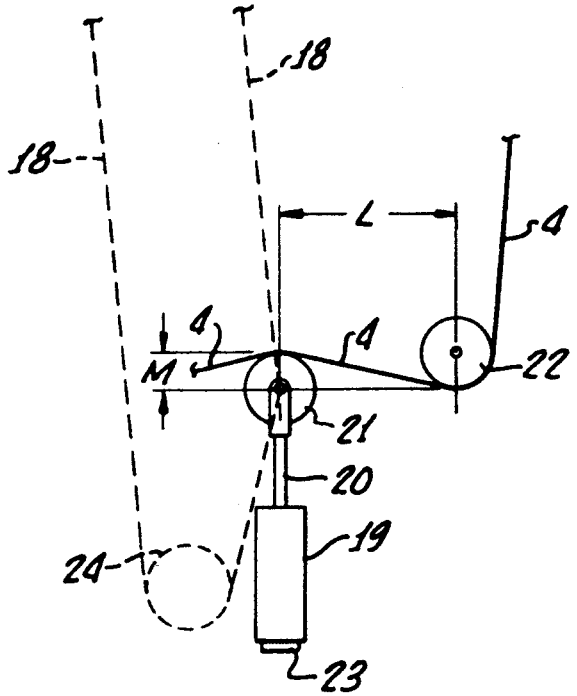
FIG. 3 shows a top view of an automatic tensioning system.

A schematic of the tensioning device is shown in FIG. 3. An actuator 19, typically powered by pressurized air, linearly moves a shaft 20 and a first pulley sheave 21 attached to the shaft 20. As the actuator 19 moves the shaft 20 outward, the first pulley sheave 21 contacts torque cable 4, applying increased tension to the cable.

The torque cable 4 is constrained to run around a second set of pulley sheaves 22 (only one shown for clarity) before extending upward toward each torque arm of the power swivel in the tensioning system shown on FIG. 1. As the first pulley sheave 21 translates outward (upward in FIG. 3), the length of the cable 4 between the second pulley sheaves 22 increases as a function of the distance "L" from the center of the first pulley sheave 21 to each of the second pulley sheaves 22. This allows the single actuator 19 of the tensioning system to apply equal increments of tension to both portions of the cable 4 running up to the crown while avoiding changes in rotary position of the torque arms 13.

The tension applied by the tensioning system 3 can also be fixed to limit the rotary motion or angle the torque arms 13 (see FIGS. 1*a* and 1*b*) can move. The predetermined tension is calculated to react against the maximum expected or rated torque of the power swivel 5 when rotating the pipe string 6. The rotary motion theoretically can be limited nearly zero, but more typically is limited to less than 10 degrees or other angles which avoids contact between the power swivel arms and other drilling equipment. As shown in FIG. 3, cable tension is a function of the outwardly directed force on shaft 20, the lateral distance "L" between first and second pulley sheaves, and the offset distance "M" between first and second pulley sheaves.

In the embodiment shown in FIG. 3, the actuator 19 is an air actuated piston within a cylinder and includes a transducer 22. The transducer 22 provides a measured indication of tensile load, which is preferably cylinder pressure, but the indication may also be the position of or loads on shaft 20. The actuator 19 pressure is related to the tension in torque cable 4 by the positions of the cable and pulley sheaves as well as cylinder piston area. Shaft position is also related to the tension in torque cable 4 by the positions of the pulley sheaves, length of the torque cable, and the modulus of elasticity of the torque cable.

The relationships allow the actuator to control the amount of tension in the cable 4 to within a range of the desired value. Preferably, the tensioning system is capable of controlling the amount of tension to within about 10 percent of the desired value so that motion is controlled without applying excessive tension loads to the drilling rig.

For example, failure of the torque cable 4 allows the actuator to outwardly move the shaft towards the end point of shaft travel. Thus, a nearly full outward position output of transducer 22 (electrical or pneumatic, for example) indicates cable failure. The indication can be used in a control system to actuator pressure to reduce tension, reduce other operations (e.g., reduce torque in the power swivel), and/or terminate operations in a fail safe system (e.g., all operations are shut down if excessive tension or cable failure is detected).

Although not recommended for most workover rig applications, one or more guy wires 18 (shown dotted as optional) may also tensioned with the actuator 19, the shaft 20 (or equivalent) attached to the guy wire(s) through an optional third pulley sheave 24 as an alternative application of the tensioning system (shown dotted as optional). Since guy wires on workover rigs are designed primarily for wind loads and are not normally in tension, rig stability and load safety calculations would be required prior to this alternative application. The actuator 19 pulls and/or slackens one or more of the attached guy wires 18.

In this alternative guy wire application, if the other end of one of the guy wires 18 is attached to or near the crown at a corner so that tension would also tend to rotate the crown, tension in that guy wire can be used to generate a moment, e.g., to react to the torque produced by the power swivel 5 and in part transferred to the rig. In still another alternative guy wire embodiment, a second guy wire and another pulley sheave can be located on the opposite side of the actuator so that outward motion of the actuator can reduce tension in the second guy wire while simultaneously increasing tension in the first guy wire. Tension control of pairs of guy wires can also be used to provide balanced moment loads on the mast.

Figure 4:
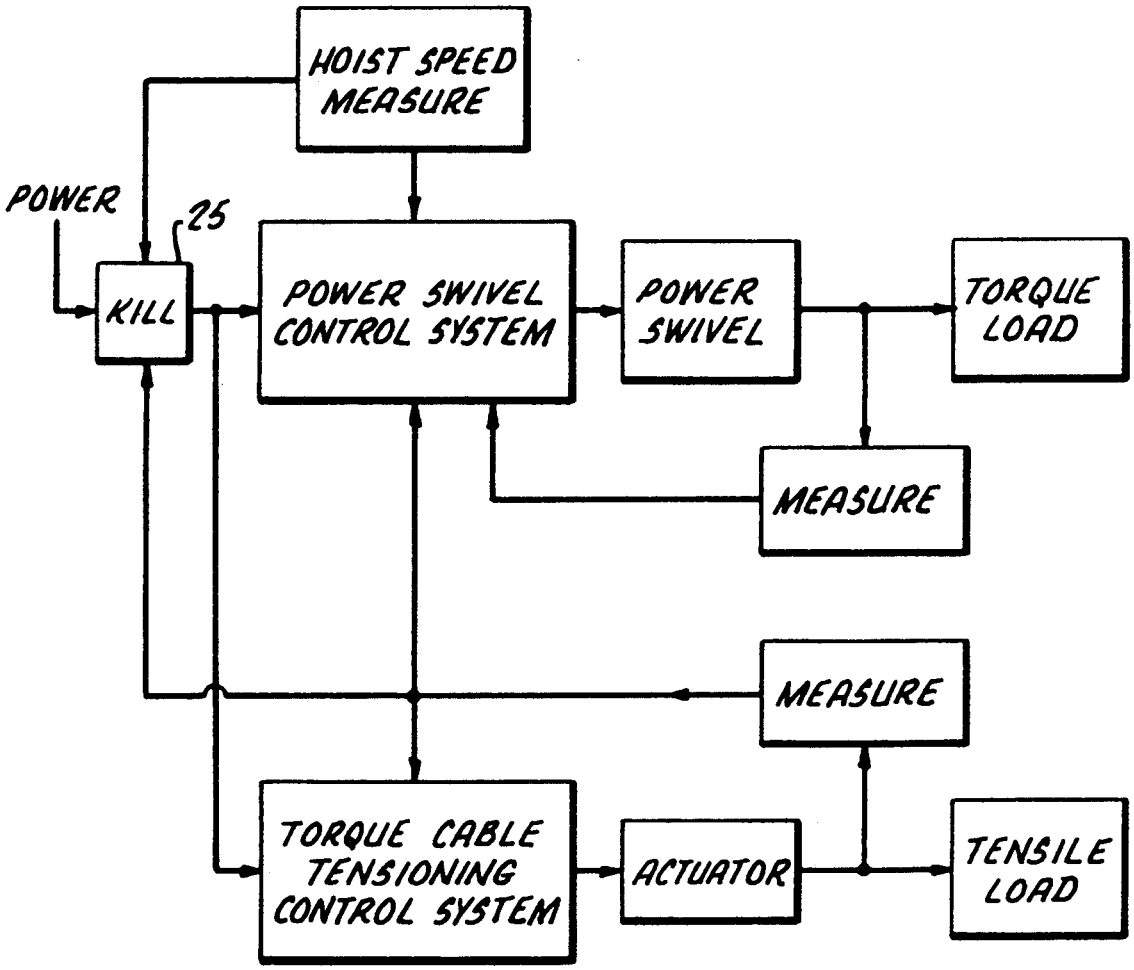
FIG. 4 shows a control schematic of a multiple line tensioning system.

FIG. 4 is a schematic of an integrated automatic control system for torque cable 4 and power swivel 5 (as shown on FIGS. 1*a* and 1*b*). Power, e.g, a source of compressed gas, is supplied through a kill valve or switch 25. The kill valve or switch 25 may be actuated manually (e.g., in an emergency), or feedback from control system transducers may actuate the kill valve or switch to interrupt power to the control systems when unsafe operations are measured or detected.

When power is not interrupted, power is supplied to the power swivel and cable tensioning (or other) control sub-systems. Interruptable power may also De supplied to hoisting and other equipment which are not shown in FIG. 4 for clarity. The control sub-systems supply controlled amounts of power to the power swivel motor and cable tensioning actuators. The output of the power swivel (e.g., rotating speed) and cable actuators (e.g., position indication) are measured and a signal (dependent upon the measure values) is fed back to one or more of the control sub-systems.

The value of the measured signals is compared to desired value(s) and the difference is used to vary the amount of power delivered to the power swivel and/or cable actuators. Measured values from other systems not shown (e.g., hoisting speed) may also be compared to desired or limit values and the difference used to vary the amount of power delivered to the operating systems.

The measurement means may be visual displays and the control means may be manually operated switches and valves, but preferably the control means includes one or more programmable microprocessors monitoring various measurement means to create an automatic tensioning system. The microprocessor can calculate loads based on measured or input values, sum, and compare loads to desired, allowable, or other limits. If measured values approach or exceed limits, e.g., too little or too much tension in a cable, modifications to the power supplied to the power swivel and/or tensioning devices is accomplished.

The invention satisfies the need to safely supply increased torque without excessive power swivel motion and without rigidly attaching the power swivel to the mast or significantly derating the mast or derrick. The tensioning system minimizes torque loads reacted by the mast structure and avoids shock loads which tend to cause twist off of the drill or other pipe string. The controlled motion improves worker safety and also allows greater individual loads (other than torque) to be applied without exceeding the safe total load limits of the drilling rig or its component parts.

The minimum and maximum torque capacity of a power swivel that can be used on a drilling rig using the automatic tensioning system varies depending upon the design of the mast, the power swivel, and cable used. Although the minimum and maximum amount of torque that can be withstood is theoretically unlimited, practical (e.g., cost and use of existing equipment) considerations typically limit application of the line tensioning system to a minimum power swivel torque capacity of at least about 2000 foot pounds. Similarly, the maximum and minimum tension developed by the automatic tensioning system is dependent upon cable and derrick capacity as well as geometry of cable attachment.

Still other alternative embodiments are possible. These include: power takeup reels on cables/wires to quickly take up slack (e.g., used prior to installing the cables/wires in the automatic tensioning system), power takeup reels used instead of the cylinder actuators 19 shown in FIG. 3, and placing the tensioning system in a protective enclosure.

While the preferred embodiment of the invention has been shown and described, and some alternative embodiments also shown and/or described, changes and modifications may be made thereto without departing from the invention. Accordingly, it is intended to embrace within the invention all such changes, modifications and alternative embodiments as fall within the spirit and scope of the appended claims.

What is claimed:

1. A tensioning apparatus for pulling a wire line fixedly attached to a crown of a well drilling rig substantially located above a ground surface, comprising:

means for pulling said wire line towards said surface and creating a tension in said wire line;

means in contact with said wire line for indicating said tension in said wire line; and means in physical communication with said wire line for controlling said means for pulling based at least in part upon indications from said means for indicating.

2. The apparatus of claim 1 wherein said pulling means stretches said wire line and said drilling apparatus comprises a power swivel for rotating a pipe string, said power swivel having an arm looped around said wire line, and wherein said tension indicating means measures the stretching of said wire line.

3. The apparatus of claim 2 wherein said wire line extends from one end fixedly attached to said crown through said pulling means and back up to the other end also fixedly attached to said crown and wherein said wire line is contactable with at least two arms of said power swivel and wherein said pulling means also comprises an actuated sheave contactable with said wire line.

4. The apparatus of claim 3 which also comprises:

a source of power for operating said pulling means;

a source of control power for supplying said controlling means; and a power shut off device capable of actuating to separate said controlling means from said control power source, wherein said actuating is based at least in part on said indication.

5. A tensioning apparatus for pulling at least one of a plurality of lines fixedly attached to a drilling rig located on a surface and capable of withstanding torsional and axial loads, said apparatus apparatus comprising:

controllable means for pulling said line towards said surface, said pulling means capable of creating a tension in said line when attached to said line; and means for controlling said pulling means based at least in part upon measured indications of a load on said apparatus, wherein said means for controlling is connected to said controllable means and located proximate to said line.

6. A process for tensioning a line connecting a drilling rig to a ground anchor using a controllable line actuator, comprising:

calculating a tension to be impressed on said line; and actuating said actuator to impress a tension on said line within about 10 percent of said calculated tension.

7. The process of claim 6 wherein said drilling rig rotates a pipe string and also comprises a power swivel having arms looped around said line, said process also comprising the steps of:

applying torque to said pipe string using said power swivel, whereby the resulting reactive torque is substantially supported by said tension in said line; and repositioning said actuator to increase said tension.

8. The process of claim 7 which also comprises:

measuring a variable indicating, at least in part, said increased tension in said line; and second repositioning said actuator based, at least in part, on said measuring step.

9. The process of claim 8 wherein said torque is at least 2500 ft-lbs and which also comprises the step of reducing said torque if said measuring indicates said increased tension is in excess of a limit amount.

10. A process for limiting the rotative motion of a plurality of arms of a power swivel while being supported by a drilling rig, said power swivel having a rated torque capacity, said process comprising:

attaching a plurality of line segments to said drilling rig;

slidably connecting said plurality of arms to said line segments; and impressing substantially equal tension on said line segments, wherein said tension is capable of limiting rotative motion of said arms to no more than 10 degrees when said power swivel is operating at rated torque capacity.

11. An apparatus for reacting to a torque load on a drilling rig including a plurality of support lines, at least one of said lines being fixedly attached to said drilling rig, said apparatus comprising:

a power swivel supported by said drilling rig and producing a moment in a first direction on said drilling rig; and controllable means for pulling said fixedly attached line connected to said line, said pulling means capable of creating a controlled tension in said line and creating a controlled moment in a direction having a component opposite to said first direction.

12. The apparatus of claim 11 wherein said drilling rig has a lifting capacity of no more than about 100 tons and said power swivel has a torque capacity of at least about 3500 ft-lbs.

13. The apparatus of claim 12 which also comprises means for controlling said pulling means based at least in part upon a measured indication of a moment on said drilling rig.

14. The apparatus of claim 13 which also comprises a kill device capable of interrupting the operation of said pulling means based at least in part on said measured indication.

15. In a drilling rig having a power swivel capable of rotating a pipe string when supported by said drilling rig and positioned by cables attached to said drilling rig, said power swivel having a torque capability limited at least in part by rotative motion of said power swivel and cables, the improvement comprising means for controlled tensioning of said cable so that a substantial increase in said torque capability limit is achieved.

16. An apparatus for reacting to an operating torque load acting in a first direction on a drilling rig located on a surface, said apparatus comprising:

at least one wire line connecting said drilling rig and an anchor located proximate to said surface; and a controllable, wire line pulling device connected to said wire line, wherein said pulling device is capable of creating a controlled tension in said wire line which produces a reactive torque on said drilling rig in a direction having a component opposite to said first direction.

* * * * *

UNITED STATES PATENT AND TRADEMARK OFFICE

CERTIFICATE OF CORRECTION

PATENT NO. : 5,368,112

DATED : November 29, 1994

INVENTOR(S) : Mount et al.

It is certified that error appears in the above-indentified patent and that said Letters Patent is hereby corrected as shown below:

Column 6, line 36, after "about" delete "2000" and replace with -- 3000 --.

Signed and Sealed this

Twenty-first Day of February, 1995

*Attest:*

Bruce Lehman

BRUCE LEHMAN

*Attesting Officer*

*Commissioner of Patents and Trademarks*